US006795683B2

(12) United States Patent
Nakazawa et al.

(10) Patent No.: US 6,795,683 B2
(45) Date of Patent: Sep. 21, 2004

(54) TANDEM TYPE PRINTING SYSTEM

(75) Inventors: Souichi Nakazawa, Hitachinaka (JP); Atsushi Miyamoto, Hitachinaka (JP)

(73) Assignee: Hitachi Printing Solutions, Ltd., Kanagawa (JP)

( * ) Notice: Subject to any disclaimer, the term of this patent is extended or adjusted under 35 U.S.C. 154(b) by 0 days.

(21) Appl. No.: 10/338,827

(22) Filed: Jan. 9, 2003

(65) Prior Publication Data

US 2003/0133731 A1 Jul. 17, 2003

(30) Foreign Application Priority Data

Jan. 11, 2002 (JP) ..... P2002-005261

(51) Int. Cl.[7] ..... G03G 15/00
(52) U.S. Cl. ..... 399/384
(58) Field of Search ..... 399/384, 385, 399/386, 387, 306, 394

(56) References Cited

U.S. PATENT DOCUMENTS 6,292,635 B1 * 9/2001 Tokairin et al. ..... 399/384
6,608,985 B2 * 8/2003 Mochimaru et al. ..... 399/309
6,650,864 B2 * 11/2003 Miyamoto et al. ..... 399/384
2002/0081132 A1 6/2002 Miyamoto et al. ..... 399/384

FOREIGN PATENT DOCUMENTS

| | | | |
|---|---|---|---|
| DE | 101 42 326 A1 | 4/2003 | |
| EP | 1 219 452 A | 7/2002 | |
| JP | 2001287421 A * | 10/2001 | ..... G03G/15/00 |
| WO | WO 96/31809 | 10/1996 | |
| WO | WO 00/10121 | 2/2000 | |

* cited by examiner

*Primary Examiner*—Arthur T. Grimley
*Assistant Examiner*—Ryan Gleitz
(74) *Attorney, Agent, or Firm*—McGuireWoods LLP

(57) ABSTRACT

A first printing device forms position alignment marks on a front surface of a web in addition to front-surface images. Information on interval of the printed alignment marks is transmitted to a second printing device, which is for forming rear-surface images on a rear surface of the web. The second printing device detects the position alignment marks. A controller controls a transport speed of the web in the second printing device such that the rear-surface images will be formed in position alignment with the front-surface images based on ideal detection timing and actual detection timing of the position alignment marks.

17 Claims, 4 Drawing Sheets

TANDEM TYPE PRINTING SYSTEM

BACKGROUND OF THE INVENTION

1. Field of the Invention

The present invention relates to a tandem type printing system including serially disposed printing devices.

2. Related Art

There have been proposed tandem type printing systems that include a pair of printing devices serially disposed for forming images on both surfaces of a web. That is, a first printing device at a front stage performs printing on a front surface of a web. The web discharged outside the first printing device is turned upside down by an inversion device, and is supplied to a second printing device at a post stage, which performs printing on a rear surface of the web.

This type of printing system uses as a web a continuous recording sheet with feed holes formed along its longitudinal edges. Systems that can use a web without feed holes are becoming popular. However, when a web with no feed holes is used, it can be difficult to align the position of the rear-surface image with the position of the front-surface image.

This is particularly a problem when the first printing device is a type of printing device that forms images using electrophotographic techniques. That is, heat generated to thermally fix the toner image transferred onto the web in place can thermally shrink the web from its initial condition. As a result, the web can be shorter when fed to the second printing device. Accordingly, because the page length when the front surface is printed on differs from the page length when the rear surface is printed on, the position of the front-surface image will not match the position of the rear-surface image, causing positional deviation between the front-surface image and the rear-surface image.

In view of foregoing, there has been proposed a following control method. That is, the first printing device forms a position-alignment mark on a leading edge of each page on the web. Then second printing device measures the distance or detection timing of the position-alignment marks. Controlling the web transport speed based on this measuring result can prevent such a positional deviation, so that the rear-surface images are formed on the position corresponding to the front-surface images.

SUMMARY OF THE INVENTION

However, even if the web transport speed is controlled in this manner, as the pages have the longer length, adjusting frequency of the web transport speed decreases, so that the positional alignment between the front-surface image and the rear-surface image becomes less precise. In other words, when the page has a longer length, the positional deviation between the front and rear surface images occurs more likely.

In the view of foregoing, it is an object of the present invention to overcome the above problems, and also to provide tandem type printing system capable of realizing precise positional alignment between front-surface images and rear-surface images on a web even if pages have an increased length.

In order to overcome the above and other objects, according to the present invention, there is provided a tandem type printing system including a first print device, a second print device, and a communication means for communicating with first print device and the second print device. The first print device includes a first printing means for forming a first-surface image on a first surface of a web. The second print device includes a second printing means for forming a second-surface image on a second surface of the web, a transport means for transporting the web, and a control means for controlling the transport means. At least the first print device includes a mark forming means for forming position-alignment marks on predetermined positions on the first surface of the web. The communication means transfers mark information on the position-alignment marks formed on the first surface to the control means of the second print device. At least the second print device includes a detection means for detecting the position-alignment marks formed on the first surface. The control means controls, based on the mark information and detection results from the detection means, the transport means to transport the web so as to match a positional phase of the second-surface image with a positional phase of the first-surface image.

There is also provided a tandem type printing system including a first print device and a second print device. The first print device includes a first printing means for forming a first-surface image on a first surface of a web. The second print device includes a second printing means for forming a second-surface image on a second surface of the web, a transport means for transporting the web, and a control means for controlling the transport means. At least the first print device includes a mark forming means for forming position-alignment marks on predetermined positions on the first surface of the web. The mark forming means forms the position-alignment marks on a plurality of locations in each page of the web. At least the second print device includes a detection means for detecting the position-alignment marks formed on the first surface. The control means controls, based on detection results from the detection means, the transport means to transport the web so as to match a positional phase of the second-surface image with a positional phase of the first-surface image.

PREFERRED EMBODIMENT OF THE PRESENT INVENTION

Next, a tandem type printing system 100 according to an embodiment of the present invention will be described with reference to attached drawings.

Figure 1:
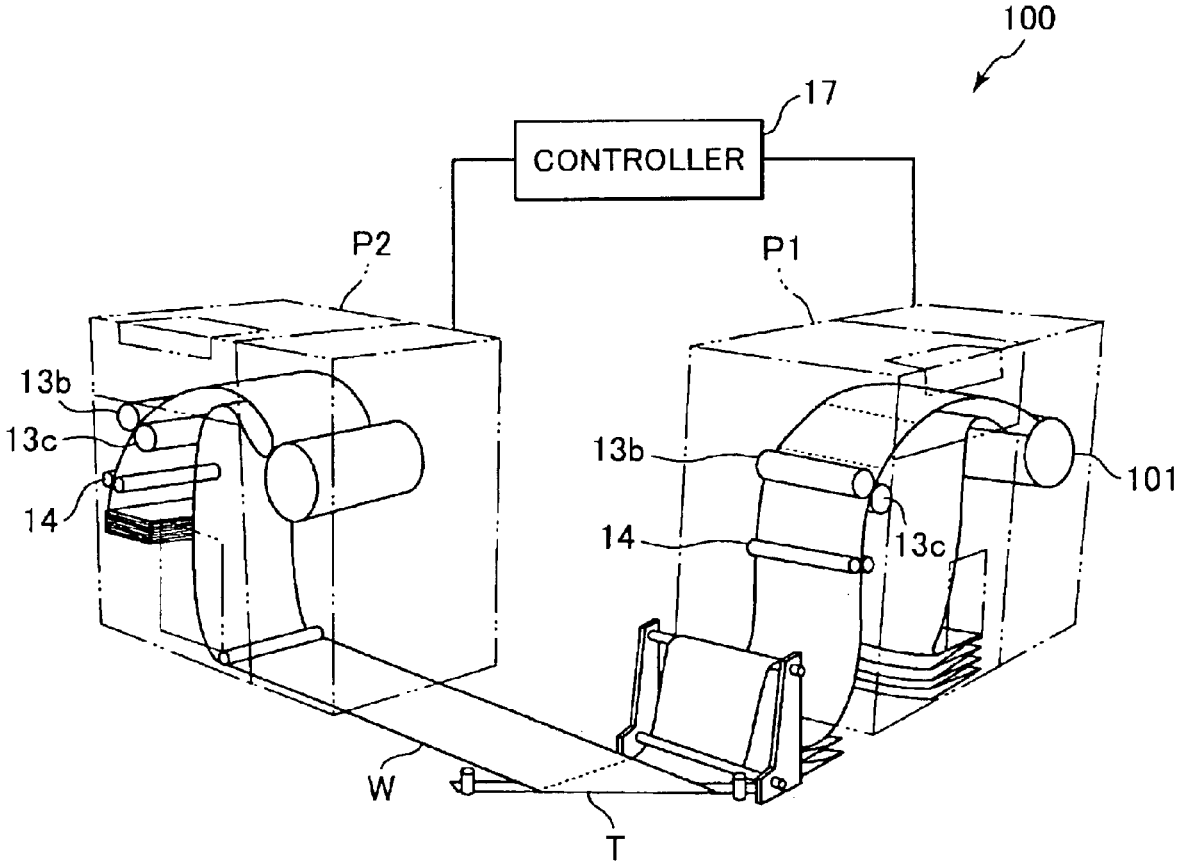
FIG. 1 is a perspective view of a tandem type printing system according to an embodiment of the present invention.

As shown in FIG. 1, the printing system 100 includes a pair of print devices P1 and P2, an inversion device T disposed between the print devices P1 and P2, and a controller 17 for controlling both the print devices P1 and P2. First, configuration of the print device P1 will be described. Here, since the print devices P1 and P2 have the same configuration, only explanation for the print device P1 will be provided. Also, since the inversion device T is well known in the art, explanation thereof will be omitted.

Figure 2:
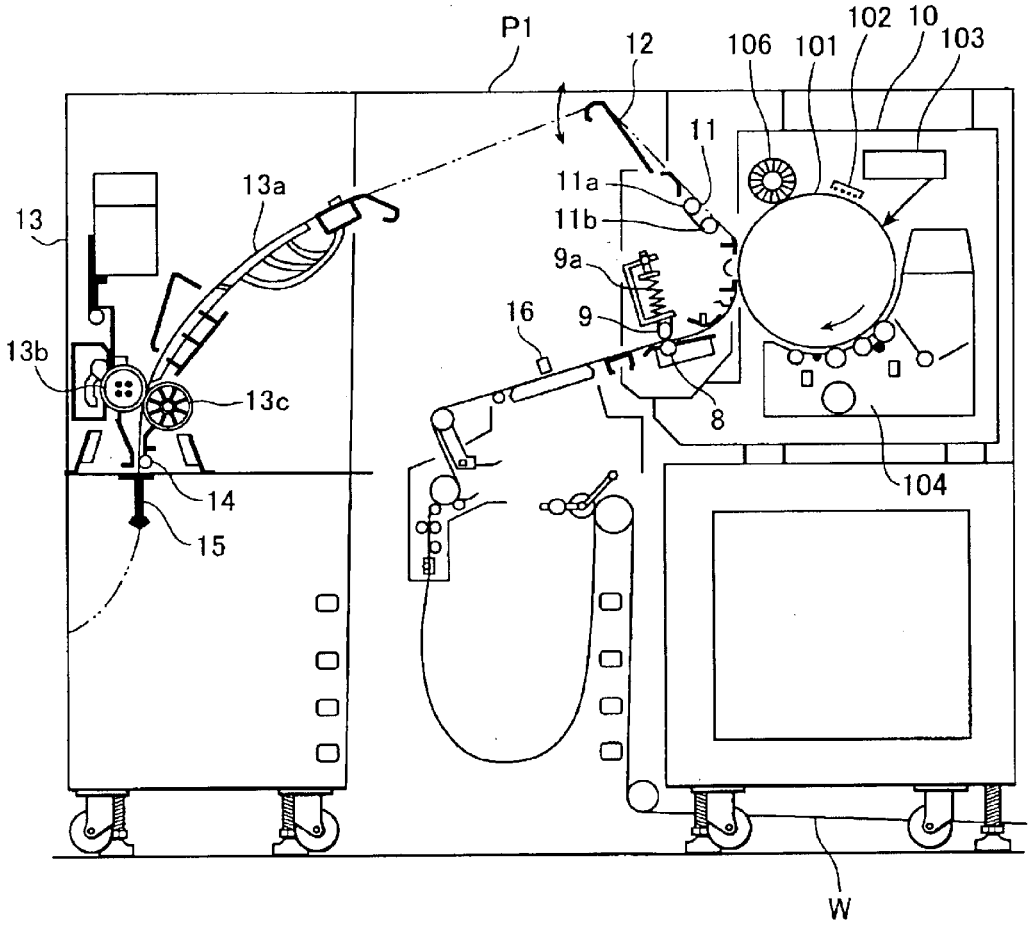
FIG. 2 is a cross-sectional view of a print device used in the printing system of FIG. 1.

As shown in FIG. 2, the print device P1 includes a pair of transport rollers 8, 9, a printing unit 10, a transport belt 11, a buffer plate 12, a fixing unit 13, a discharge roller 14, a swing fin 15, and a mark sensor 16. The transport roller 8 is a drive roller having its own driving source, and the transport roller 9 is a driven roller that is urged onto the transport roller 8 via a web W by an urging force of a spring 9*a*. The transport belt 11 is wound around and extending between a driving roller 11*a* and a driven roller 11*b*.

Rotation of the transport rollers 8, 9 transports the web W to the printing unit 10, which is an electrophotographic printing device in this embodiment. The printing unit 10 includes a photosensitive drum 101, a corona charging unit 102, a light source 103, a developing unit 104, and a transfer unit 105. When the photosensitive drum 101 starts rotating, the corona charging unit 102 is applied with a high voltage so as to uniformly charge the surface of the photosensitive drum 101. The light source 103, which is formed of a semiconductor laser or a light-emitting diode, irradiates a light beam on the photosensitive drum 101, whereby an electrostatic latent image is formed on the photosensitive drum 101.

When the electrostatic latent image comes into confrontation with the developing unit 104, the electrostatic latent image is developed into a visible toner image on the photosensitive drum 101. Thus formed toner image is transferred onto a front surface of the web W by the transfer unit 105 having an opposite polarity from that of the toner image. The web W with the toner image transferred thereon is supplied onto the transport belt 11, and further transported along the buffer plate 12. Although not shown in the drawings, there is provided a suction member that enables the transport belt 11 to transport the web W with its rear surface attached to the transport belt 11 by generating suctioning force. Then, the web W reaches the fixing unit 13.

The fixing unit 13 includes a pre-heater 13*a*, a heat roller 13*b*, and a pressure roller 13*c* that presses against the heat roller 13*b*, thereby defining a nip portion therebetween. The web W having reached the fixing unit 13 is preheated by the pre-heater 13*a*, and then further transported through the nip portion between the pre-heater 13*a* and the heat roller 13*b*. At this time, the toner image is thermally fused onto the web W.

The web W discharged from the fixing unit 13 is further transported to the discharge roller 14, and usually the web W is folded back and forth into an accordion fold by the swing movement of the swing fin 15 and stored in the print device P1. However, because the print device P2 is disposed behind the print device P1 in this printing system 100, the web W discharged from the fixing unit 13 is discharged outside the print device P1 via the discharge roller 14. Thus discharged web W is turned upside down by the inversion device T and then supplied into the print device P2 where images are formed on a rear surface of the web W.

The mark sensor 16 is for detecting position-alignment marks (described later) formed in the web W and outputting mark detection signals.

Figure 3:
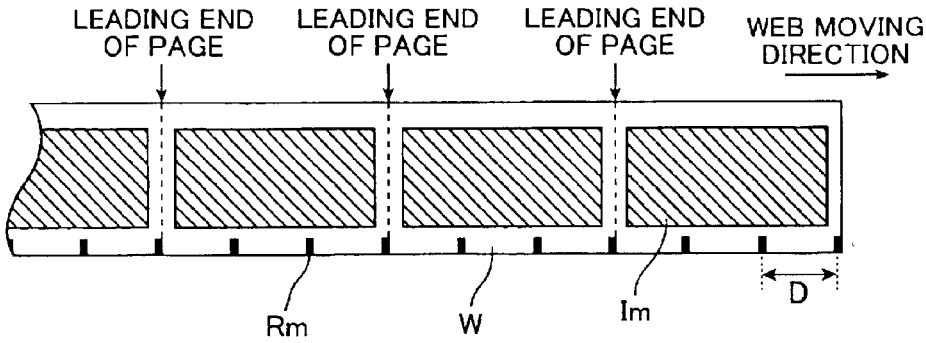
FIG. 3 is a plan view of a web formed with position-alignment marks.

The print device P1 having the above configuration forms images Im shown in FIG. 3 on the front surface of the web W based on print data, and in addition, position-alignment marks Rm on the leading end of each page and also on remaining portions with equidistance from each other. A distance between adjacent position-alignment marks Rm is set to a distance D. Mark information on the distance D is stored in a memory (not shown) provided in either print device P1 or the controller 17 and transmitted to the print device P2 by the controller 17. Here, the position-alignment marks Rm can be formed by a mechanism that is either the same as or different from the mechanism that forms the image Im. In this embodiment, the position-alignment marks Rm is formed along with the image Im by the same mechanism.

The web W discharged from the print device P1 is turned upside down by the inversion device T, and then supplied into the print device P2, wherein the front surface of the web W formed with the image Im and the position-alignment marks Rm comes into confrontation with a detection surface of the mark sensor 16, and the rear surface of the web W with no images comes into confrontation with the photosensitive drum 101.

Figure 6:
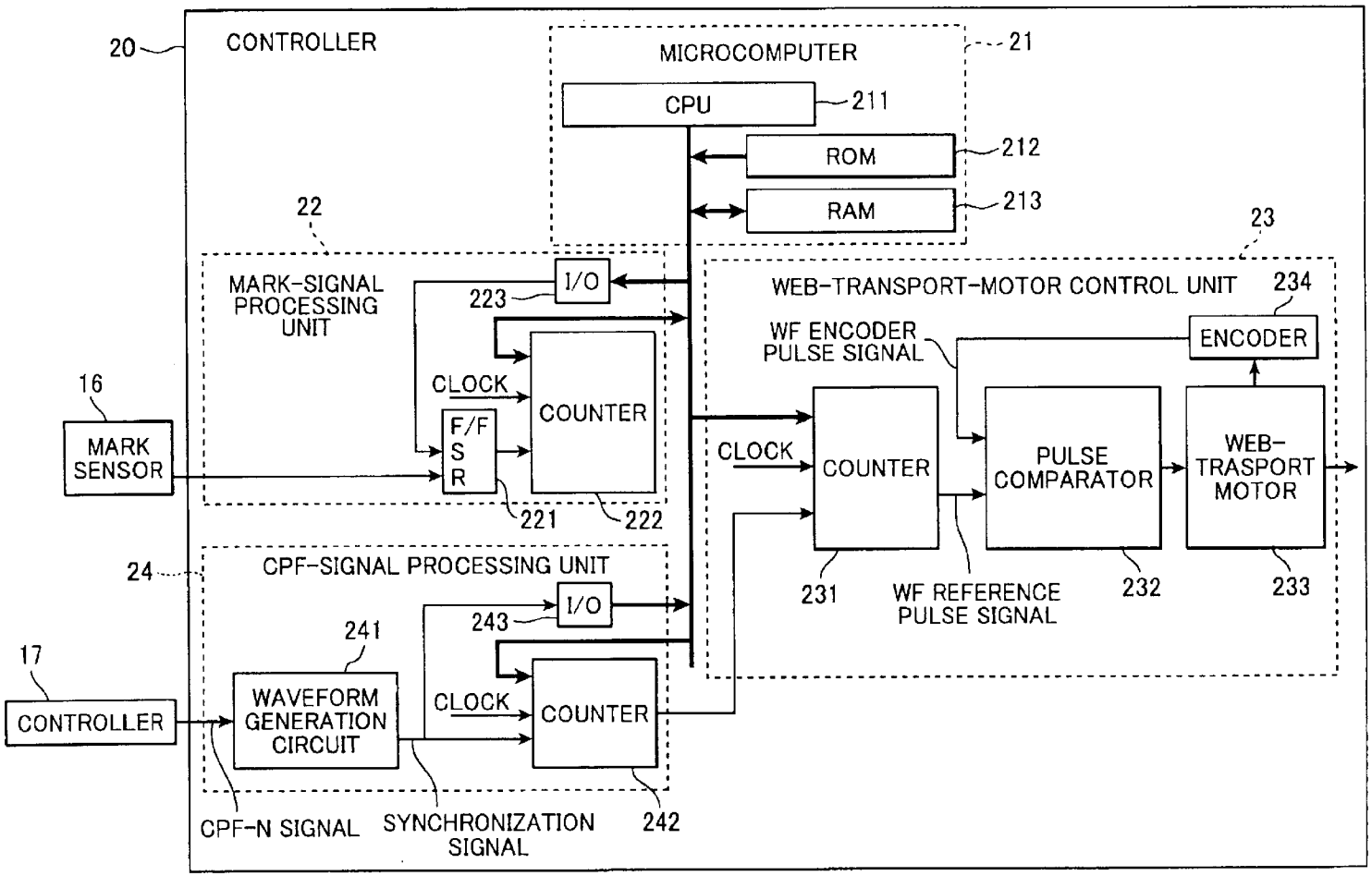
FIG. 6 is a block diagram of a controller of the print device.

In addition to the above configuration, at least the print device P2 includes a controller 20 shown in FIG. 6. The controller 20 includes a microcomputer 21, a mark-signal processing unit 22, a web-transport-motor control unit 23, and a CPF-signal processing unit 24. The microcomputer 21 includes a central processing unit (CPU) 211 for executing calculation and control of other components, a read only memory (ROM) 212 storing operation programs of the CPU 211, and a random access memory (RAM) 213 for temporarily storing calculation results or the like.

The mark-signal processing unit 22 includes a flip-flop 221, a counter 222, and an I/O device 223. The flip-flop 221 is connected to the mark sensor 16. The counter 222 starts counting down from an initial count value, which is set by the microcomputer 21, when a signal from the I/O device 223 is applied to a set terminal S of the flip-flop 221, and the counter 222 stops counting down when the mark detection signal from the mark sensor 16 is input to a reset terminal R of the flip-flop 221.

The web-transport-motor control unit 23 includes a counter 231, a pulse comparator 232, a web-transport motor 233, and an encoder 234. The counter 231 outputs a WF reference pulse signal when the counter 231 counts down to 0 from an initial count value, which is set by the microcomputer 21. The web-transport motor 233 is for driving the transport roller 8 or the like to transport the web W. The encoder 234 outputs a WF encoder pulse signal in synchronization with the driving movement of the web-transport motor 233. Both the WF reference pulse signal and the WF encoder pulse signal are input to the pulse comparator 232, so that the pulse comparator 232 controls the driving speed of the web-transport motor 233 based on these signals in a manner described later.

The CPF-signal processing unit 24 includes a waveform generation circuit 241, a counter 242, and an I/O device 243.

Next, process executed in the print device P2 will be described. During printing operations, the photosensitive drum 101 rotates at a predetermined process speed vp, and toner images formed on the photosensitive drum 101 are transferred onto the surface of the web W at a transfer point TP shown in FIG. 4 where the photosensitive drum 101 contacts the web W. The controller 20 controls a web transport speed such that a position-alignment mark Rm on the web W and a corresponding position PP that is imaginary defined on the surface of the photosensitive drum 101 meet at the transfer point TP in order to achieve the positional alignment between the front-surface images and the rear-surface images. Details will be described next.

Figure 4:
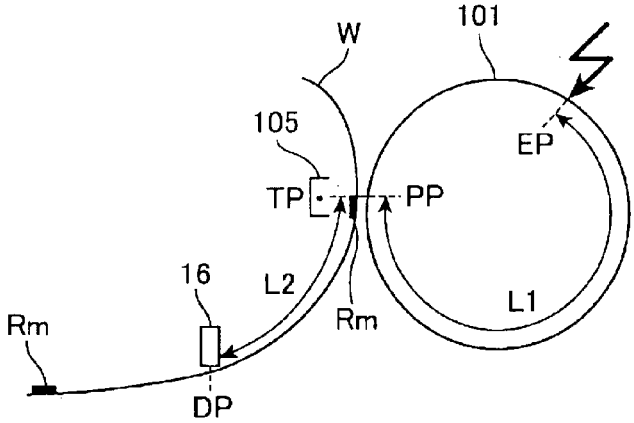
FIG. 4 is an enlarged view of a photosensitive drum and neighboring components of the print device.

As shown in FIG. 4, there is a moving distance L1 of the photosensitive drum 101 from an irradiation point EP to the transfer point TP. The irradiation point EP is where the laser beam from the light source 103 is irradiated on the photosensitive drum 101. Also, there is a moving distance L2 of the web W from a detection point DP where the mark sensor 16 detects the position-alignment marks Rm to the transfer point TP. In order to make the position PP and the corresponding position-alignment mark Rm to reach the transfer point TP at the same time, the position PP should be located upstream from the transfer point TP by the distance L2 at the time of when the mark sensor 16 detects the corresponding position-alignment mark Rm at the detection point DP that is upstream from the transfer point TP by the distance L2.

In the present embodiment, "control timing" will be referred to a theoretical detection timing of the position-alignment mark Rm when the web W is being transported in an appropriate web-transport speed wherein the position-alignment mark Rm will meet the corresponding position PP at the transfer point TP so that a rear-surface image is formed in the same positional phase as a corresponding front-surface image. With this definition, positioning of a rear-surface image is controlled so that the actual detection timing constantly matches the control timing.

Figure 5:
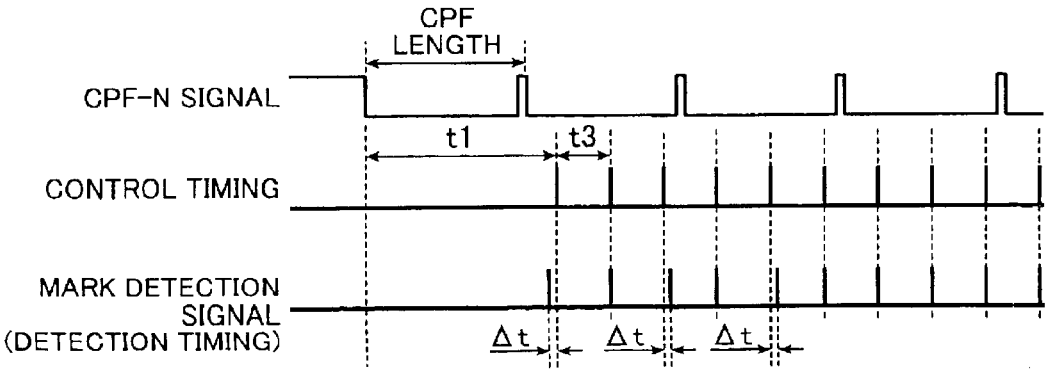
FIG. 5 is a timing chart of a positioning control.

As shown in FIG. 5, the controller 17 outputs a CPF-N signal to the print device P2 once each time the light source 103 starts irradiating the laser beam on the photosensitive drum 101 at the irradiating point EP for each page. A time t1 from output timing of a first CPF-N signal to a control timing of an $n^{th}$ position-alignment mark Rm from the head of the web W is calculated by a formula:

$$t1=(L1-L2)/vp+t3\times(n-1) \quad (1)$$

wherein:

L1 is the moving distance of the photosensitive drum 101 from the irradiating point EP to the transfer point TP;

L2 is the moving distance of the web W from the detection point DP to the transfer point TP;

vp is the process speed at which the photosensitive drum 101 rotates;

t3 is a time duration required to transport the web W by the distance D that is a distance between adjacent position-alignment marks Rm; and n is the number of a subjected position-alignment mark Rm.

It should be noted that the time t3 is calculated by the CPU 211 based on the mark information on the distance D transmitted from the controller 17.

That is, as shown in FIG. 5, the first control timing is a time t1 after the output of the first CPF-N signal, and the following control timing occurs once every time t3. During the actual printing, the controller 20 compares the actual detection timing with the control timing obtained from the above formula (1). If the actual detection timing does not match the control timing, then the controller 20 calculates a time difference Δt between them and controls the web-transport speed based on the time difference Δt. That is, if the actual detection timing is earlier than the control timing, then the controller 20 reduces the web-transport speed. On the other hand, if the actual detection timing is later than the control timing, then the controller 20 increases the web-transport speed. In this manner, the controller 20 controls the web-transport speed such that the actual detection timing matches the control timing to make the position-alignment mark Rm and the corresponding position PP meet at the transfer point TP.

More specifically, as shown in FIG. 6, the CPF-N signal is input to the waveform generation circuit 241 of the CPF-signal processing unit 24, and the waveform generation circuit 241 outputs a synchronization signal to the counter 242 in synchronization with the lowering timing of a first CPF-N signal. A predetermined counter value has been previously stored in the counter 242 by the CPU 211, and the counter 242 starts counting down in response to the synchronization signal. When the counter value of the counter 242 is counted down to 0, then, the counter 242 outputs a pulse signal to the web-transport-motor control unit 23. That is, this pulse signal is generated when a predetermined time, which is designated by the CPU 211, has elapsed after the lowering timing of the first CPF-N signal. In response to the pulse signal, the web-transport motor 233 starts driving the transport roller 8 to transport the web W. The synchronization signal output from the waveform generation circuit 241 is also input to the CPU 211 through the I/O device 243. In response to the synchronization signal, the CPU 211 inputs a predetermined counter value corresponding to the time t1 into the counter 222 of the mark-signal processing unit 22. At the same time, a signal from the I/O device 223 is applied to the set terminal S of the flip-flop 221 and the counter 222 starts counting down. When the mark detection signal from the mark sensor 16 is input to the reset terminal R of the flip-flop 221, then the counter 222 stops counting down. Accordingly, the microcomputer 21 can obtain the time difference Δt by retrieving the count value of the counter 222 when the counter 222 has stopped counting down.

Thereafter, the microcomputer 21 inputs a predetermined count value corresponding to the time t3 into the counter 222 each time the position-alignment mark Rm is detected. The microcomputer 21 can obtain the time difference Δt by retrieving the count value of the counter 222 at the time of when the counter 222 has stopped counting down in response to the mark detection signal being applied to the flip-flop 221.

As described above, both the WF encoder pulse signal and the WF reference pulse signal are input to the pulse comparator 232. The pulse comparator 232 controls the speed of the web-transport motor 233 so that these two pulse signals are generated in synchronization with each other. Accordingly, if the microcomputer 21 increases the count value of the counter 231, then the web transport speed decreases. On the other hand, if the microcomputer 21 decreases the count value of the counter 231, then the web transport speed increases. In this manner, by changing the count value of the counter 231 based on the difference Δt, a target web-transport speed can be achieved.

As described above, according to the present embodiment, because the position-alignment mark Rm and the corresponding position PP are controlled to meet at the transfer point TP, it is possible to precisely match the leading edge of each page on the front surface with the leading edge of corresponding page on the rear surface.

Also, because the web-transport speed is adjusted plural times while the web W is transported by a single-page worth of distance, that is, because the frequency of the timing to control the web-transport speed is increased, the positional alignment between the front-surface image and the rear-surface image can be precise even when the page has an increased length with respect to a web transporting direction. This provides a highly reliable tandem type printing system capable of precisely forming images on both sides of a web.

Further, because the information on the position-alignment marks Rm, such as the information on the interval D of adjacent position-alignment marks Rm, is transmitted to the print device P2, it is possible to reliably achieve the positioning alignment between the front-side images and the rear-side images even if the interval of the position-alignment marks has been changed.

Here, it should be noted that because the print device P2 starts forming a first-page image on the rear surface of the web after the operator places the web W on a predetermined position of the print device P2, usually there is no positional deviation of images between the front surface and the rear surface of the web.

While some exemplary embodiments of this invention have been described in detail, those skilled in the art will recognize that there are many possible modifications and variations which may be made in these exemplary embodiments while yet retaining many of the novel features and advantages of the invention.

Here, it is possible to store value Δt into the RAM 213 each time the position-alignment mark Rm is detected. Then the CPU 211 calculates a difference Δtv between a previous value Δto and a latest value Δtn using the following formula:

$$\Delta tv=(\Delta tn-\Delta to \quad (2)$$

Then, the web-transport-motor control unit 23 increases or decreases the current web-transport speed v by a speed Δv, which is calculated using a formula:

$$\Delta v=(\Delta tv/t3)\times v \quad (3)$$

In this manner, a target web-transport speed can be achieved.

What is claimed is:

1. A tandem type printing system, comprising:

a first print device including a first printing means for forming a first-surface image on a first surface of a web;

a second print device including a second printing means for forming a second-surface image on a second surface of the web, a transport means for transporting the web, and a control means for controlling the transport means; and a communication means for communicating with the first print device and the second print device, wherein:

at least the first print device includes a mark forming means for forming position-alignment marks on predetermined positions on the first surface of the web;

the communication means transfers mark information on the position-alignment marks formed on the first surface to the control means of the second print device;

at least the second print device includes a detection means for detecting the position-alignment marks formed on the first surface; and the control means controls, based on the mark information and detection results from the detection means, the transport means to transport the web so as to match a positional phase of the second-surface image with a positional phase of the first-surface image.

2. The tandem type printing system according to claim 1, wherein the position-alignment marks are formed on a plurality of locations in each page of the web, the plurality of locations equally dividing the each page.

3. The tandem type printing system according to claim 1, wherein the mark information on the position-alignment marks is information on an interval of the position-alignment marks.

4. The tandem type printing system according to claim 1, wherein at least the first printing means of the first print device is an electrophotographic printing means.

5. The tandem type printing system according to claim 1, wherein the control means controls the detection means to match the positional phase of the second-surface image with the positional phase of the first-surface image by changing a web-transport speed.

6. The tandem type printing system according to claim 1, wherein the second print device further includes a photosensitive drum, and the control means compares an actual detection timing at which the detection means first detects one of the position-alignment marks after printing operation starts and a control timing (t1) obtained from a formula, $$t1=(L1-L2)/vp+t3\times(n-1)$$

wherein L1 is a moving distance of the photosensitive drum from an irradiating point to a transfer point, L2 is a moving distance of the web from a detection point to the transfer point, vp is a process speed at which the photosensitive drum rotates, t3 is a time duration required to transport the web by a distance that is a distance between adjacent position-alignment marks, and n is a number of the one of the position-alignment marks counted from a head of the web.

7. The tandem type printing system according to claim 6, wherein the control means reduces a web transport speed if the actual detection timing is earlier than the control timing, and the control means increases the web transport speed if the actual detection timing is later than the control timing.

8. The tandem type printing system according to claim 6, wherein the control means calculates a time difference between the actual detection timing and the control timing and controls a web transport speed based on the time difference.

9. The tandem type printing system according to claim 8, further comprising a memory that stores the time difference each time one of the positional-alignment marks is detected.

10. The tandem type printing system according to claim 9, wherein the control means increases or decreases the web transport speed by a speed (Δv) using a formula, $$\Delta v=(\Delta tv/t3)\times v$$

wherein Δtv is the difference between a previous time difference and a latest time difference, and v is the web transport speed.

11. A tandem type printing system comprising:

a first print device including a first printing means for forming a first-surface image on a first surface of a web;

a second print device including a second printing means for forming a second-surface image on a second surface of the web, a transport means for transporting the web, and a control means for controlling the transport means, wherein:

at least the first print device includes a mark forming means for forming position-alignment marks on predetermined positions on the first surface of the web, the mark forming means forming the position-alignment marks on a plurality of locations in each page of the web;

at least the second print device includes a detection means for detecting the position-alignment marks formed on the first surface; and the control means controls, based on detection results from the detection means, the transport means to transport the web so as to match a positional phase of the second-surface image with a positional phase of the first-surface image.

12. A printing system, comprising:

a first print device to form an image and a plurality of position-alignment marks on a first surface of a web, where intervals between the plurality of position-alignment marks comprise mark information;

a second print device to form a second image on a second surface opposite the first surface of the web;

a transport device to transport the web;

a detection unit to detect the plurality of position-alignment marks formed on the first surface;

a control unit controlling the transport device to transport the web so as to substantially match a positional phase of the second image with a positional phase of the first image by using the mark information; and a communication unit to communicate with the first print device and the second print device, the communication unit transferring the mark information of the plurality of position-alignment marks formed on the first surface to the control unit.

13. The printing system of claim 12, wherein the first print device forms the plurality of position-alignment marks on a plurality of locations in each page of the web.

14. The printing system of claim 12, wherein the first printing device includes an electrophotographic printing unit.

15. The printing system of claim 12, wherein the second print device includes a photosensitive drum, and the control unit calculates a time difference between an actual detection timing at which the detection unit detects one of the position-alignment marks and a control timing (t1) and controls a web transport speed based on the time difference, the control timing (t1) being obtained from a formula, $$t1=(L1)-(L2)/vp+t3\times(n-1),$$

wherein L1 is a moving distance of the photosensitive drum from an irradiating point to a transfer point, L2 is a moving distance of the web from a detection point to the transfer point, vp is a process speed at which the photosensitive drum rotates, t3 is a time duration required to transport the web by a distance that is a distance between adjacent position-alignment marks, and n is a number of the one of the position-alignment marks.

16. The printing system of claim 15, wherein the control unit reduces the web transport speed if the actual detection timing is earlier than the control timing, and the control unit increases the web transport speed if the actual detection timing is later than the control timing.

17. A tandem type printing system comprising:

a first print device including a first printing means for forming a first-surface image on a first surface of a web;

a second print device including a second printing means for forming a second-surface image on a second surface of the web, a transport means for transporting the web, and a control means for controlling the transport means; and a communication means for communicating with the first print device and the second print device, wherein:

the first print device includes a mark forming means for forming position-alignment marks on predetermined positions on the first surface of the web;

the communication means transfers mark information on the position-alignment marks formed on the first surface to the control means of the second print device;

the second print device includes a detection means for detecting the position-alignment marks formed on the first surface, the detection means being located upstream of the second printing means with respect to a web-transport direction; and the control means controls, based on the mark information and detection results from the detection means, the transport means to change a web-transport speed.

* * * * *